US005938855A

United States Patent [19]

Bowden, Jr.

[11] Patent Number: 5,938,855

[45] Date of Patent: Aug. 17, 1999

[54] METHOD FOR CLEANING A TURBINE COMPONENT

[75] Inventor: Joseph H. Bowden, Jr., Mason, Ohio

[73] Assignee: General Electric Company, Cincinnati, Ohio

[21] Appl. No.: 09/009,236

[22] Filed: Jan. 20, 1998

[51] Int. Cl.[6] ..... B08B 3/12; C23G 1/02

[52] U.S. Cl. ..... 134/1; 134/3; 134/28; 134/41

[58] Field of Search ..... 134/1, 3, 2.16, 134/22.17, 28, 41

[56] References Cited

U.S. PATENT DOCUMENTS

| | | | |
|---|---|---|---|
| 3,607,398 | 9/1971 | Lucas | 134/3 |
| 3,997,361 | 12/1976 | Kendall | 134/28 |
| 4,119,437 | 10/1978 | Arendt et al. | 134/3 |
| 4,639,327 | 1/1987 | McGaha | 134/41 |
| 4,707,191 | 11/1987 | Martinou et al. | 134/3 |
| 5,275,671 | 1/1994 | Rivenaes | 134/42 |
| 5,575,858 | 11/1996 | Chen et al. | 134/3 |

*Primary Examiner*—Jill Warden
*Assistant Examiner*—Saeed Chaudhry
*Attorney, Agent, or Firm*—Andrew C. Hess; Gerry S. Gressel

[57] ABSTRACT

A method of removing surface dirt and contaminants from a component, such as a turbine, combustor or augmentor component of a gas turbine engine. The processing steps generally include soaking the component in a solution containing acetic acid, agitating the surfaces of the component such as with ultrasonic energy, and then rinsing the component of the acetic acid solution. A preferred acetic acid solution is vinegar either diluted by water or used full strength. Preferably, the component is also immersed in a solution containing acetic acid during the agitation step. The treatment steps can be performed at room temperature for durations of as little as two hours. The method is particularly suited for the removal of silica and calcium-containing compounds from air-cooled components protected with an environmental coating such as a diffusion aluminide coating.

20 Claims, No Drawings

METHOD FOR CLEANING A TURBINE COMPONENT

FIELD OF THE INVENTION

This invention relates to cleaning processes and solutions. More particularly, this invention is directed to a process for removing dirt and other foreign matter that are adhered to the surfaces of gas turbine engine components following engine operation.

BACKGROUND OF THE INVENTION

The operating environment within a gas turbine engine is both thermally and chemically hostile. Significant advances in high temperature alloys have been achieved through the formulation of iron, nickel and cobalt-base superalloys, though components formed from such alloys often cannot withstand long service exposures if located in certain sections of a gas turbine engine, such as the turbine, combustor and augmentor. A common solution is to protect the surfaces of such components with an environmental coating, i.e., a coating that is resistant to oxidation and hot corrosion. Coatings that have found wide use for this purpose include diffusion aluminide coatings and overlay coatings such as MCrAlY. During high temperature exposure in air, these coatings form a protective aluminum oxide (alumina) scale that inhibits oxidation of the coating and the underlying substrate. Diffusion aluminide coatings are particularly useful for providing environmental protection to components equipped with internal cooling passages, such as high pressure turbine blades, because aluminides are able to provide environmental protection without significantly reducing the cross-sections of the cooling passages.

The surfaces of gas turbine engine components are typically cleaned and, if necessary, refurbished during engine overhaul and repair. High pressure turbine components such as blades and vanes are particularly susceptible to a build up of dirt and foreign matter that must be removed to promote the service life of the component. In particular, dirt buildup within the cooling passages of a blade reduces cooling efficiency, causing increased operating temperatures for the blade. Vibratory tumbling techniques employed to clean gas turbine engine components have been successful at removing dirt from the external surfaces, but with little affect on dirt and contaminants such as silica and calcium compounds adhered to internal surfaces of components. Failure to remove silica and other contaminants from internal surfaces of components has been shown to promote hot corrosion attack during subsequent exposures to elevated temperatures.

Removal of internal dirt and contamination has generally necessitated the use of solutions, including caustics such as potassium hydroxide employed in an autoclave cleaning operation. Autoclaving has been found to be effective at removing adherent surface contaminants, but is generally not practical for field servicing due to the complexity and cost of the equipment required. Treatments with hydrofluoric acid have been successfully used to remove silica, but resulted in the formation of calcium fluoride on the treated surfaces. Other types of solutions that have found use are those containing chelating agents. A notable example is VERSENE 220, one of a series of solutions based on ethylenediaminetetraacetic acid (EDTA) commercially available under the name VERSENE from the Dow Chemical Company. Soaking in VERSENE 220 advantageously is able to loosen both silica and calcium compounds from the internal and external surfaces of a blade when ultrasonic cleaning is included. However, neutralization of VERSENE 220 with hydrochloric acid has been found necessary to prevent hot corrosion attack of the internal cooling surfaces of blades by residual VERSENE 220 during subsequent exposures to elevated temperatures. Unfortunately, the HCl treatment has been found to be aggressive toward platinum aluminide (PtAl) environmental coatings. The requirement for a hydrochloric acid treatment and resulting attack of PtAl coatings have been eliminated by the use of DIAMMONIUM VERSENE, a VERSENE solvent containing diammonium EDTA. However, proper treatment and disposal of this solution can be complicated, as is the case with VERSENE 220.

From the above, it can be appreciated that the process for removing surface buildup of dirt and contaminants on gas turbine engine components is complicated by the cleaning effectiveness, aggressiveness toward coating materials, and disposal considerations of the various solutions currently used.

SUMMARY OF THE INVENTION

The present invention generally provides a method of removing surface dirt and contaminants from a component, such as a turbine, combustor or augmentor component of a gas turbine engine. The method is particularly suited for the removal of silica and calcium-containing compounds from air-cooled components protected with an environmental coating such as a diffusion aluminide coating.

The processing steps of this invention generally include soaking the component in a solution containing acetic acid, agitating the surfaces of the component such as with ultrasonic energy, and then rinsing the component of the acetic acid solution. A preferred acetic acid solution is vinegar in its commercially-available form, used full strength. Preferably, the component is also immersed in a solution containing acetic acid during the agitation step. The treatment steps can be performed at room temperature for durations of as little as two hours.

According to the invention, weak acetic acid solutions such as vinegar have been unexpectedly found to loosen surface contaminants such as silica and calcium-containing compounds from the internal and external surfaces of a component, such as an air-cooled turbine blade, and enable dirt and surface contaminants to be readily removed by agitation of the surfaces, such as with an ultrasonic cleaning operation. Advantageously, the weak acetic acid solutions of this invention have been found to be compatible with aluminide coatings, including platinum aluminides susceptible to attack by prior art solutions. In addition, disposal of acetic acid does not pose the problems associated with the disposal of EDTA-containing solutions. Finally, surfaces treated with a weak acetic acid solution and on which residual solution remains have not been found to be susceptible to hot corrosion attack during subsequent exposures to elevated temperatures, as is the case with certain prior art solutions.

Other objects and advantages of this invention will be better appreciated from the following detailed description.

DETAILED DESCRIPTION OF THE INVENTION

The present invention is generally applicable to gas turbine engine components that are subjected to airborne contaminants at high temperatures, which build up on the surfaces of the components in the form of dirt and scale deposits that tenaciously adhere to the component surface.

Notable examples of such components include the high and low pressure turbine nozzles and blades, shrouds, combustor liners and augmentor hardware of gas turbine engines. Of particular interest to the invention are air-cooled components protected with a diffusion aluminide coating, such as high pressure turbine blades having internal air passages through which air is forced to transfer heat from the blade. While the advantages of this invention will be described with reference to turbine blades, the teachings of this invention are generally applicable to any component whose surfaces must be occasionally cleaned of dirt and contaminants that adhere to the component surfaces.

The method of this invention entails treating the surfaces of such components with a weak acetic acid solution, an example of which is vinegar which typically contains about 4 to 8 weight percent acetic acid. According to this invention, weak acetic acid solutions have been surprisingly determined to be highly effective at loosening silica and calcium-containing compounds and deposits formed at operating temperatures of gas turbine engines. While vinegar is generally preferred as the treatment solution of this invention due to availability and cost, it is foreseeable that stronger and weaker acetic acid solutions derived by other methods could be used.

The process of this invention preferably entails soaking the component in the acetic acid solution at room temperature, though temperatures as high as the boiling temperature of the solution are possible. This operation is carried out to ensure that all surfaces of the component, including any internal surfaces such as those formed by cooling passages, are contacted by the solution. During this step, surface contaminants such as silica and calcium-containing compounds can be loosened by the acetic acid solution without the solution attacking any protective environmental coating present on the component surface. A duration of about two hours has been found to be adequate to sufficiently loosen scale deposits of these contaminants, though it is foreseeable that treatments of longer and shorter durations could be used, depending on the amount of contaminants present.

Following the above soak, the surfaces of the component are agitated, such as by ultrasonic energy, to clean the component surfaces. During this step, the component is again preferably immersed in a weak acetic acid solution, e.g., vinegar, though it is possible that water could be used. As with the soaking step, cleaning can be performed at room temperature. Suitable parameters for an ultrasonic cleaning operation can be readily ascertainable by those skilled in the art, with shorter durations being possible when the component is subjected to higher ultrasonic energy levels. Generally, a two hour duration using a commercially-available ultrasonic cleaner has been found to be sufficient to remove a majority of the contaminants loosened or otherwise released from the external surfaces and internal air passages of an air-cooled turbine blade. The component is then rinsed with water or another suitable rinse to remove the acetic acid solution from the internal and external surfaces of the component.

During evaluations of this invention, high pressure turbine blades were evaluated that had been retrieved from service and found to have dirt and scale deposits (generally silica and calcium-containing compounds adhering to their protective diffusion aluminide coatings. Each of the blades was soaked in distilled white vinegar at room temperature for about eight hours with periodic brushing. During the treatment, it was observed that the scale deposits steadily loosened, with complete removal of such deposits from the external surfaces of the blades being achieved by the end of the eight hour treatment.

Two additional high pressure turbine blades having similar surface contaminants were then soaked in white vinegar for about fifty minutes, followed by ultrasonic cleaning for ten minutes to complete a one-hour cycle. One of the blades was about 95% free of internal and external surface contaminants after three cleaning cycles, while the second was 50% free of contaminants. Finally, other turbine blades with platinum aluminide coatings were exposed to vinegar at room temperature for durations of up to about twenty-four hours without showing any evidence of attack. Accordingly, it is believed that the treatment method of this invention can be performed for durations sufficient to remove surface contaminants without attacking and degrading the aluminide coatings often present on gas turbine engine components for protection from their harsh operating environment.

While our invention has been described in terms of a preferred embodiment, it is apparent that other forms could be adopted by one skilled in the art. For example, suitable acetic acid solutions could contain other constituents, both inert and active. Accordingly, the scope of our invention is to be limited only by the following claims.

What is claimed is:

1. A method for removing dirt and other foreign matter from the surface of a gas turbine engine component, the method comprising the steps of:

soaking the component in a solution consisting essentially of acetic acid;

agitating the surface of the component; and then rinsing the component of the solution containing acetic acid.

2. A method as recited in claim 1, wherein the solution employed to soak the component consists essentially of vinegar.

3. A method as recited in claim 1, wherein the component is immersed in a solution containing acetic acid during the agitation step.

4. A method as recited in claim 1, wherein the component is a turbine blade protected by an environmental coating, and wherein the method does not attack and degrade the environmental coating.

5. A method as recited in claim 1, wherein the soaking step is performed at approximately room temperature.

6. A method as recited in claim 1, wherein the soaking step is performed for a duration of at least two hours.

7. A method as recited in claim 1, wherein the agitation step is performed for a duration of at least two hours.

8. A method as recited in claim 1, wherein the component is rinsed with water during the rinsing step.

9. A method as recited in claim 1, wherein the component has internal surfaces formed by air passages within the component, the soaking and agitation steps being performed such that dirt and other foreign matter are removed from the internal surfaces of the component.

10. A method as recited in claim 1, wherein silica and calcium-containing compounds are loosened by the solution during the soaking step.

11. A method comprising the steps of:

providing a gas turbine engine component protected by an environmental coating, the component having internal and external surfaces, with dirt and foreign matter adhering to the internal and external surfaces of the component;

soaking the component in a solution consisting essentially of acetic acid;

ultrasonically cleaning the component while the component is immersed in a solution containing acetic acid; and then rinsing the component with water to remove the solutions containing acetic acid from the internal and external surfaces of the component;

wherein the soaking and ultrasonic cleaning steps remove the dirt and other foreign matter from the internal and external surfaces of the component without attacking and degrading the environmental coating.

12. A method as recited in claim 11, wherein the solution employed by the soaking step consists of vinegar.

13. A method as recited in claim 11, wherein the solution employed by the ultrasonic cleaning step consists of vinegar.

14. A method as recited in claim 11, wherein the component is a turbine blade.

15. A method as recited in claim 11, wherein the soaking step is performed at approximately room temperature.

16. A method as recited in claim 11, wherein the soaking step is performed for a duration of at least two hours.

17. A method as recited in claim 11, wherein the ultrasonic cleaning step is performed at approximately room temperature.

18. A method as recited in claim 11, wherein the ultrasonic cleaning step is performed for a duration of at least two hours.

19. A method as recited in claim 11, wherein silica and calcium-containing compounds are loosened by the solution employed by the soaking step.

20. A method as recited in claim 11, wherein the environmental coating is a diffusion aluminide.

* * * * *